United States Patent [19]

Ulrich et al.

[11] Patent Number: 4,542,616

[45] Date of Patent: Sep. 24, 1985

[54] AUTOMATIC CARTON SEALING APPARATUS

[75] Inventors: Lawrence W. Ulrich; Connie W. Walker, both of Bolingbrook, Ill.

[73] Assignee: Durable Packaging Corporation, Chicago, Ill.

[21] Appl. No.: 441,842

[22] Filed: Nov. 15, 1982

[51] Int. Cl.[4] ..... B65B 61/00; B65B 51/06

[52] U.S. Cl. ..... 53/137; 198/627; 156/468

[58] Field of Search ..... 53/76, 137, 368, 374; 156/468, 475; 198/627

[56] References Cited

U.S. PATENT DOCUMENTS

| | | | |
|---|---|---|---|
| 2,803,935 | 8/1957 | Gibson | 53/137 X |
| 3,124,914 | 3/1964 | Eissmann et al. | 53/374 X |
| 3,267,640 | 8/1966 | Romney et al. | 53/374 X |
| 3,623,293 | 11/1971 | Boulay | 53/374 |
| 4,161,138 | 7/1979 | Marchetti | 53/137 X |

*Primary Examiner*—Robert L. Spruill
*Assistant Examiner*—Michael D. Folkerts
*Attorney, Agent, or Firm*—Dressler, Goldsmith, Shore, Sutker & Milnamow, Ltd.

[57] ABSTRACT

An apparatus for automatically sealing random sized cartons having directly connected and positive acting arm control mechanisms acting on both ends of each arm to provide pure transverse motion of the side arms. The apparatus also includes novel lift means for raising and lowering the sealing means and preventing any wobble or lateral movement thereof. Means are provided for synchronizing the operation of both mechanisms.

4 Claims, 8 Drawing Figures

AUTOMATIC CARTON SEALING APPARATUS

BACKGROUND AND SUMMARY OF THE INVENTION

This invention relates to apparatus for automatically sealing the folding flaps of random size cartons by applying thereto self-adhesive tape material and, more particularly, to improvments in the means for: (1) automatically raising and lowering the taping head assembly, and (2) automatically positioning the cooperating carton-gripping side arm assemblies.

In the packaging industry, corrugated and fiberboard cartons have been used for many years and various machines have been developed which are capable of sealing the carton either by gluing the flaps, taping the flaps or by stapling or otherwise providing mechanical fasteners to maintain the flaps in a closed condition. Many of those machines are designed to accept cartons of varying or random width and height by providing various types of sensing means to control the transverse movement of the carton conveying side arms and the vertical positioning of the top sealing means. Examples of such machines are disclosed in U.S. Pat. Nos. 4,044,527; 4,079,577; and 4,173,105; as well as our copending application Ser. No. 377,336, now U.S. Pat. No. 4,392,911 all having the same assignee as the present invention.

Apparatus of the type described is understandably subjected to fairly heavy stresses which, when frequently repeated, can have the tendency to adversely affect the efficiency of the reciprocating assemblies. Where such wear necessitates replacement of parts or frequent manual re-adjustments in order to maintain desired efficiency of operation, the result is wasteful down time and expense. The need thus exists for greater durability and reliability of operation without increased cost.

The present invention provides a novel frame and support structure for the tape sealing assembly which permits raising and lowering but prevents undesirable wobbling or later movement thereof. The vertical lift assembly includes adjustable eccentrically mounted pressure rollers and pressure wear strips which cooperate with the supporting frame to insure vibration-free and wobble-free operation of the tape sealing means.

The side arm control mechanism of the invention provides positive and reliable movement of the side arms toward and away from each other as required. The novel control mechanism includes a system of sprockets and chains which are connected directly to the side arm assemblies and operate to insure pure transverse movement of the side arms without undesirable angular or rotional movement.

Cylinder drive means is provided for the two control mechanisms and includes adjustment means for controlling the press with which the tape is applied to the cartons. The vertical lift assembly and the side arm control assembly operate synchronously and thus cooperate to provide an apparatus which is most efficient, durable and simple to operate and maintain.

DESCRIPTION OF A PREFERRED EMBODIMENT

Figure 1:
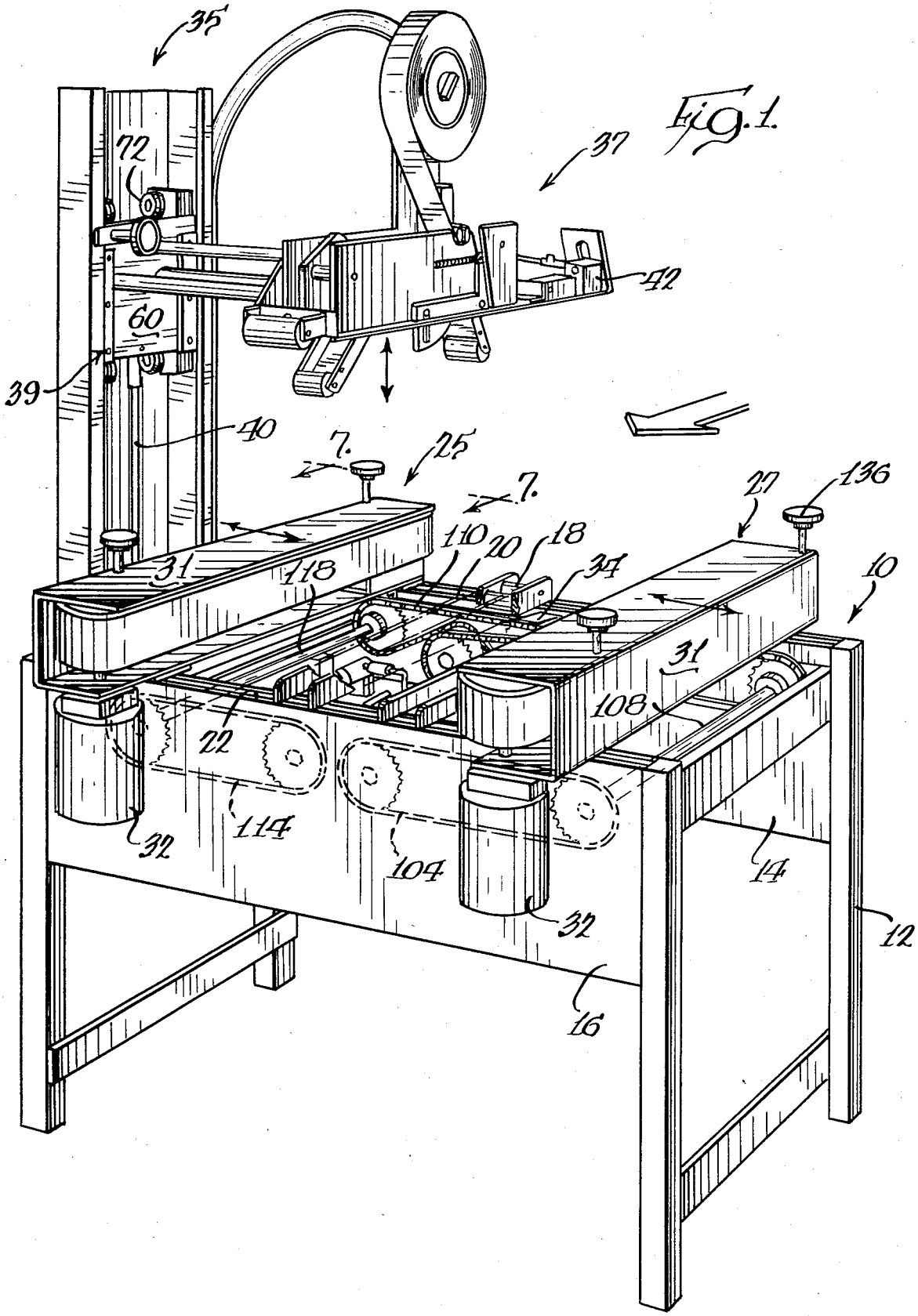
FIG. 1 is a perspective view of a carton sealing apparatus embodying the principles of the invention with portions broken away and omitted for clarity of illustration.

Referring now in greater detail to the drawings, and particularly to FIG. 1 thereof, it will be seen that the reference numeral 10 indicates generally a carton sealing machine incorporating the novel lift control mechanism and side arm control mechanism of the invention. The carton sealing machine 10 will be discussed only briefly and in such detail as is necessary for an understanding of the present invention, it being understood that the invention may likewise be incorporated in alternative types of carton sealing machines.

Carton sealing machine 10 comprises a frame structure 12 having an entrance or upstream wall 14 and an exit or downstream wall 16. One or more roller conveyor sections such as 18 extends longitudinally between the walls 14 and 16 and provide a conveyor bed for readily transporting the workpiece cartons thereover. The frame walls 14 and 16 are provided with transverse tracks 20 and 22 opening to the tops thereof, and opposed side arm assemblies 25 and 27 are mounted for reciprocal movement in said tracks. Each of the side arm assemblies 25 and 27 includes an endless gripping belt 28 supported for rotation about vertical shafts 30, a housing 31, a drive motor 32 connected to one of said shafts, and a belt-tensioning mechanism 33 (See FIG. 6). Conventional switch means such as 34 are positioned at the level of the conveyor bed and are adapted to be contacted by an entering carton to activate the inventive mechanism for reciprocating the side arm assemblies in a manner which will be described in detail below.

A vertical support column 35 is connected to a lateral edge of the frame structure 12 and said column carries a tape head assembly 37 for applying tape to the upper side and top surfaces of a carton passing thereunder. The tape head assembly 37 is mounted from a carriage assembly 39 capable of reciprocal movement in the column 35 in a manner which will be subsequently described in detail. Vertical movement of the carriage 39 is achieved by direct connection to the rod 40 of a cylinder (not shown), and operation of said cylinder is controlled by an activator switch 42 carried on the nose of the tape head assembly 37.

Briefly stated, the operation of the carton sealing machine 10 is in the following manner which is known in the prior art. In their normal non-operative condition, the side arm assemblies 25 and 27 are opened apart to their widest extent and the tape head assembly 37 is descended to its lowest position above the conveyor bed sections 18. As a carton is fed manually by an operator onto the conveyor bed, its leading top edge first contacts the switch 42 causing extension of the rod 40 and raising of the tape head assembly 37 above the path of the carton. In sequentially timed relationship, and substantially simultaneously, the leading bottom edge of the carton contacts the switch 34 to activate the control mechanism for drawing the side arm assemblies toward each other until the rotating belts 28 grip the sides of the carton. While the side arm assemblies are conveying the carton, the switch 42 has been opened and the tape head assembly 37 descends by gravity to rest on the top of the carton and apply the tape thereto. After the trailing bottom edge of the carton passes the switch 34, and after a short time delay, the side arm assemblies are withdrawn to their open condition to await the next carton-sealing cycle. In conjunction with the foregoing description of operation, it should be understood that the carton sealing machine 10 may likewise include a bottom tape head assembly for taping the bottom of a carton and which would be a mirror image of the top tape head assembly illustrated.

Figure 3:
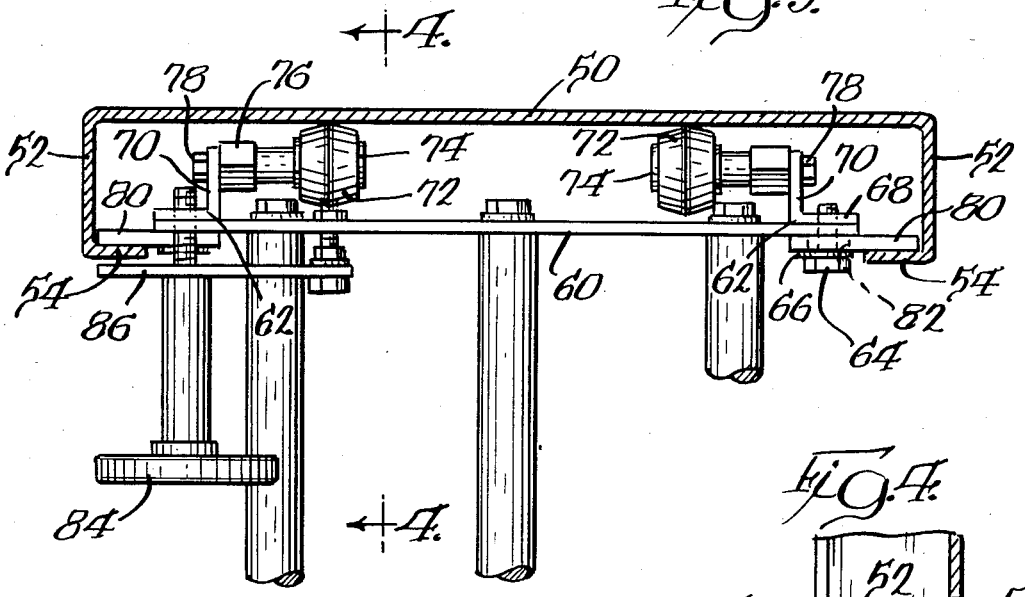
FIG. 3 is a horizontal sectional view taken on the plane of line 3—3 in FIG. 2 and viewed in the direction indicated.
Figure 2:
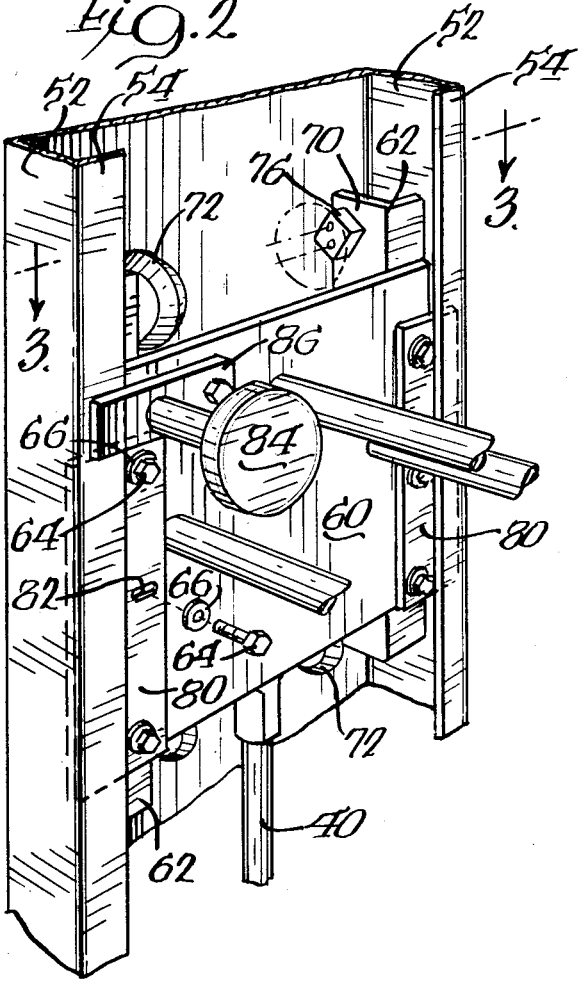
FIG. 2 is an enlarged fragmentary perspective view of the lift assembly associated with the top sealing head assembly; with one of the retaining bolts removed to show a detail of the wear strip construction.
Figure 4:
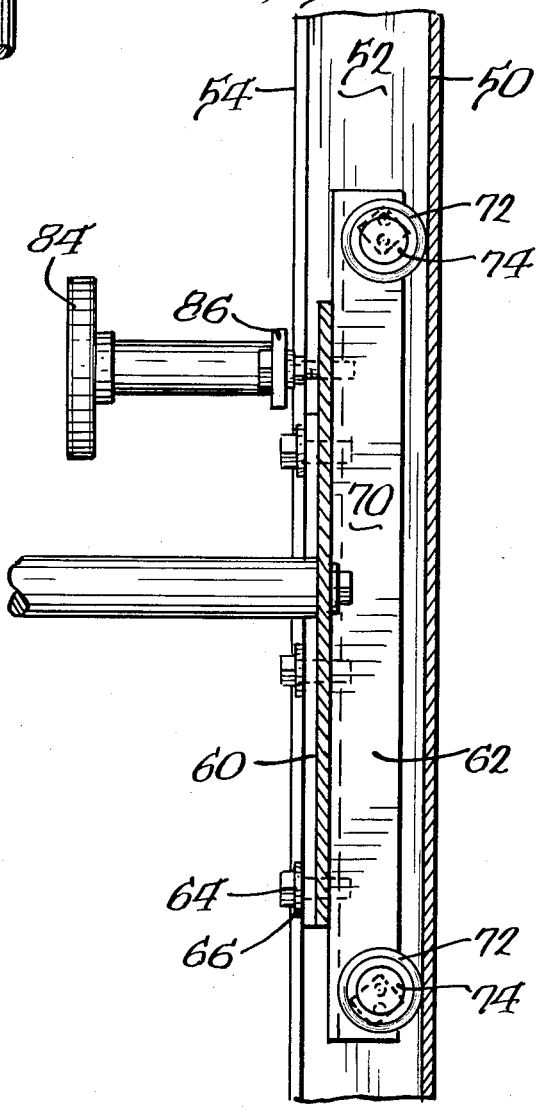
FIG. 4 is a vertical sectional view taken on the plane of line 4—4 in FIG. 3 and viewed in the direction indicated.

The novel lift means of the invention for raising and lowering the tape head assembly 37 will now be described in detail, with particular reference to FIGS. 2–4 of the drawings. As shown in said Figures the vertical support column 35 comprises an integral channel-shaped member having a back wall 50, a pair of side walls 52, 52, and a pair of short front walls 54, 54.

The carriage assembly 39 comprises a vertical carriage plate 60 dimensioned to have clearance for vertical movement between the channel side walls 52, 52. Vertical angle bars 62, 62 are releasably secured to the rear surface of the plate 60 adjacent the lateral edges thereof by suitable means such as the bolts 64 and washers 66 illustrated. Each of the angle bars 62 comprises a front wall 68 and a rearwardly extending inner wall 70, and it will be noted that the length of said inner walls is less than the length of the channel side walls 52 so that clearance is provided between said inner walls and the channel back wall 50.

A pressure roller 72 is rotatably and adjustably mounted at the opposite ends of each of the angle bar inner walls 70, and is adapted to bear against the channel back wall 50. In the embodiment illustrated, the rollers 72 comprise bearing loaded wheels connectable to a support by an outside threaded axle bolt 74. The axle bolt 74 is adapte to be received in either of two threaded bores formed at opposed corners of a square mounting and adjustment nut 76. The mounting nut 76 is itself releasably connected to the inner surface of the angle bar wall 70 by a bolt 78 received in the threaded hole opposed to that receiving the axle bolt 74. It will thus be appreciated that the rollers 72 are eccentrically mounted with relation to the adjustment nut 76 so that said nuts may be adjustably set to vary the pressure with which the rollers bear against the back wall 50 of the support column.

Mounted on the front surface of the carriage plate 60 adjacent the lateral edges thereof is a pair of slide strips 80, 80 made of a durable, low-friction material such as, for example, teflon. The slide strips 80 are formed with horizontal adjustment slots 82 and are dimensioned to bear against the side walls 52 as well as the front walls 54 of the channel member 50. By suitable adjustment of the nuts 76 and slide strips 80, the carriage assembly 39 (and supported tape head assembly 37) is most securely retained in the support column while reciprocal vertical motion thereof is in no way impeded.

On those occasions when the cartons being sealed are all of a single size, it may be desirable to eliminate or forego use of the switch activated automated operation already described and pre-set the tape head assembly 37 in a fixed position. For this purpose, the carriage plate 60 has mounted thereon an adjustable hand brake 84 adapted to bring a lock plate 86 into locking engagement with a front wall 54 of the support member.

Figure 5:
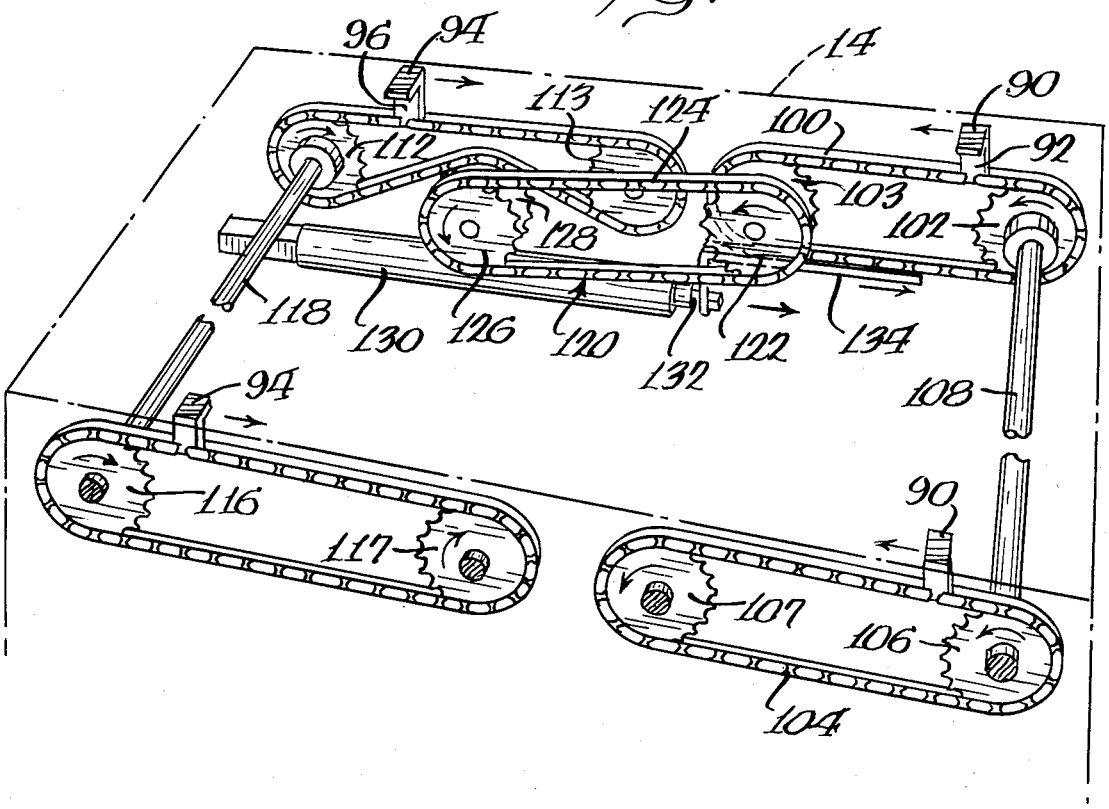
FIG. 5 is a fragmentary perspecitve view of the side arm control mechanism.
Figure 6:
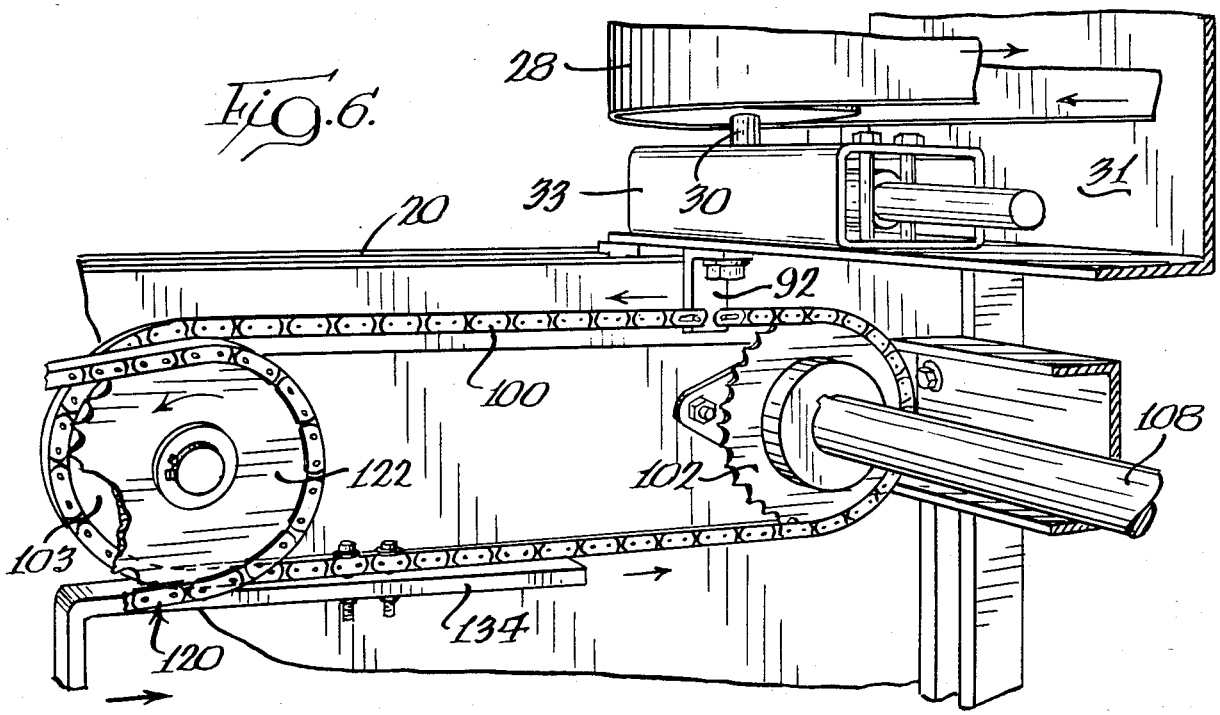
FIG. 6 is an enlarged perspective detail view showing the direct connection of the side arm control mechanism to one of the arms.
Figure 7:
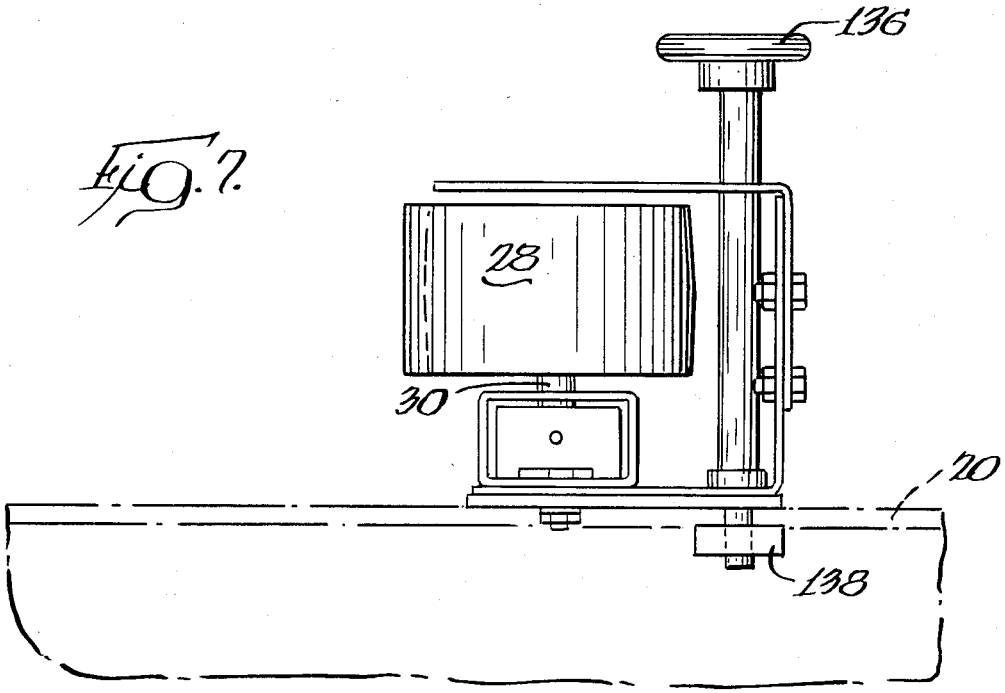
FIG. 7 is an end elevational view of one of the side arms taken on the plane of line 7—7 in FIG. 1 and viewed in direction indicate.

Referring now to FIGS. 1, 5 and 6, the side arm control mechanism of the invention will be described. A pair of angle links 90 is secured to the housing 31 of the side arm assembly 27. Each of said links 90 comprises a depending leg 92 and said legs are positioned slightly inwardly of the frame upstream and downstream walls 14 and 16. A pair of angle links 94 having depending legs 96 are similarly secured to the housing 31 of the opposite side arm assembly 25.

A drive sprocket chain 100 is carried by a pair of sprocket wheels 102 and 103, rotatably mounted on the inner surface of the upstream wall 14 and the leg 92 of the associated upstream link 90 is rigidly connected to the upper run of said chain. An opposed drive sprocket chain 104 is similarly carried by a pair of sprocket wheels 106 and 107 rotatably mounted on the downstream wall 16, and the leg 92 of the associated link 90 is rigidly connected to the upper run of the chain 104. The two drive sprocket wheels 102 and 106 are directly linked by a longitudinal drive rod 108 so that the chains 100 and 104 rotate in tandem.

A similar driven sprocket chain and wheel assembly is associated with the side arm assembly 25. Thus, the depending leg 96 of the upstream link 94 is rigidly connected to the upper run of a chain 110 carried on wheels 112 and 113 while the downstream link 94 is connected to the upper run of a chain 114 carried on wheels 116 and 117. The wheels 112 and 116 are directly connected by a longitudinal rod 118.

The drive sprocket chains 100 and 104 and driven sprocket chains 110 and 114 are operationally connected through a direction reversal linkage 120. The direction reversal linkage 120 comprises a sprocket wheel 122 mounted on a common shaft with and pinned to the wheel 103 and inwardly thereof. The wheel 122 is linked by a chain 124 to a wheel 126 mounted on a common shaft with and pinned to a sprocket wheel 128. The sprocket wheel 128 lies in the same vertical plane as the wheels 112 and 113 and substantially midway there between so that the bottom run of the chain 110 is caused to ride thereon. With the sprocket arrangement described it will be seen that any rotation of the chain 100 in one direction will cause the chain 104 to rotate in the same direction but the chains 110 and 114 to rotate in the opposite direction as clearly shown by the arrows in FIG. 5. Since each of the side arm assemblies 25 and 27 is directly linked to the chains at opposite ends thereof, pure transverse movement of the side arms toward and away from each other for efficient gripping of a carton is achieved.

Motive force is imparted to the side arm control mechanism by means of a longitudinally extending pneumatic cylinder 130 having an extensible rod 132. The rod 132 carries an elongated push bar 134 which is rigidly connected to the bottom run of the drive chain 100. When the rod 132 is in the fully retracted position, the side arm assemblies 25 and 27 are at their widest separation as illustrated in FIG. 5. Extension of the rod 132 results in movement of the side arms toward each other as already explained.

As in the case of the tape head assembly, the side arm assemblies 25 and 27 are provided with manually operable brake 136 adapted to grip the trackway structure 20 with lock plates 138 for maintaining the side arms in a fixed position where such operation is desired.

Figure 8:
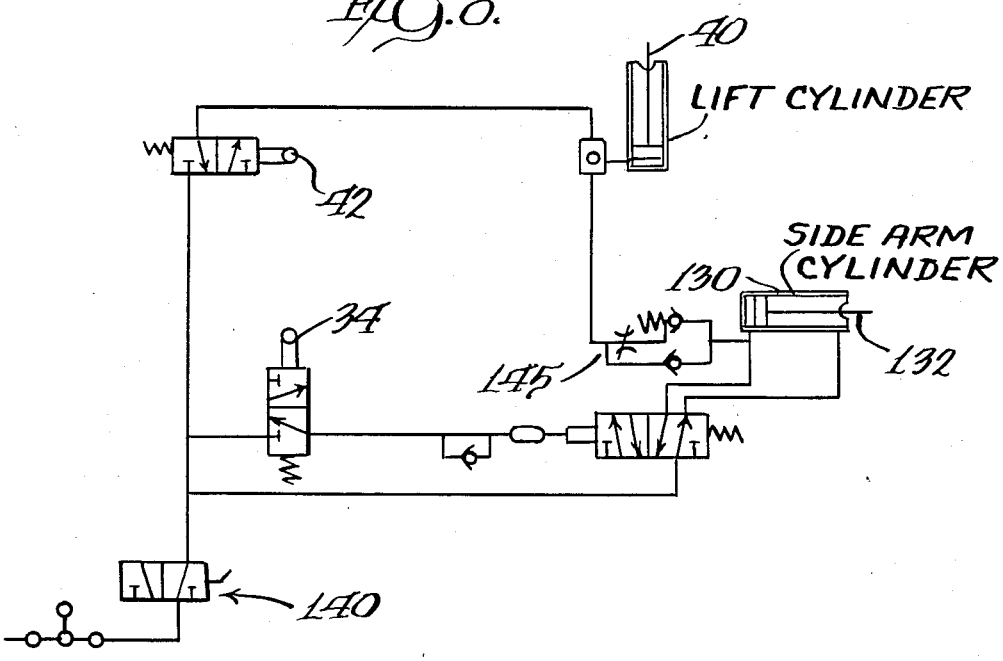
FIG. 8 is a schematic circuit diagram of the switch activated pneumatic cylinders for driving the two control mechanisms of the invention.

The pneumatic circuitry for operating the control mechanisms of the invention may best be appreciated by referring to FIG. 8 of the drawings. The switch 42 located on the tape head assembly operates the valve control causing upward extension of the rod 40 and movement of the tape head assembly. The switch 34 activates the valve controls which cause extension of the rod 132 to reciprocate the side arm assemblies. While other arrangements, or even hydraulic cylinders may be employed, the embodiment illustrated operates pneumatically at a system pressure of 70 psi. When fixed pre-set positions are desired for sealing cartons of uniform size, the automated operation may be eliminated entirely by means of a bypass selector switching arrangement 140.

Those skilled in the art will appreciate that it is sometimes desirable to vary the pressure with which the tape head assembly bears against the top of the carton. For example, where the cartons are only partially filled or comprise a relatively fragile material, the simple gravitational weight of the tape head assembly might tend to crush the carton. To provide for such control, the present invention comprises a bias pressure control system 145 which applies a normal bias pressure of 30 psi to the bottom of the lift cylinder. As indicated, that pressure is adjustable by means of a regulator to vary the bias pressure and the effective weight of the tape head assembly on the cartons.

Various modifications are contemplated and may obviously be resorted to by those skilled in the art without departing from the spirit and scope of the invention, as hereinafter defined by the appended claims, as only a preferred embodiment has been disclosed.

What is claimed is:

1. Apparatus of the type used for sealing the foldable flaps of cartons of random sizes, said apparatus including a frame structure, a vertically movable sealing head means mounted to said frame structure, and carton conveying means having a pair of facing longitudinally extending side arm means mounted to said frame structure so as to permit transverse movement of said side arm means towards and away from each other, said side arm means having upstream ends and downstream ends, said side arm means having endless conveyor belts engageable with opposite sides of said carton to move the same through said sealing head means; and improved mechanism for transversely moving said side arm means towards and away from each other comprising:

(a) four pairs of transversely spaced sprocket wheels supported for simultaneous rotation about a substantially horizontal axis, two pairs being associated with the upstream ends of said side arm means and two pairs being associated with the downstream ends of said side arm means;

(b) linkage means connecting the end portions of each of said side arm means to an associated one of said pairs of sprocket wheels;

(c) drive means for rotating said sprocket wheels in a clockwise and counter-clockwise direction, such rotary motion of said sprocket wheels being translated to linear motion at said side arm means through said linkage means; and (d) direction reversing sprocket wheel means supported for rotation about a substantially horizontal axis, said direction-reversing sprocket wheel means being operationally connected to said upstream pairs of sprocket wheels whereby the direction of rotation of said upstream pairs of sprocket wheels is always opposed.

2. The invention as defined in claim 1 wherein said linkage means comprises an angle link depending from said side arm means and rigidly connected to the upper run of the chain carried by its associated pair of sprocket wheels.

3. The invention as defined in claim 2 wherein said drive means includes an air cylinder and a drive bar carried by the rod of said cylinder, said drive bar being rigidly connected to the bottom run of the chain supported by one of said upstream pairs of sprocket wheels.

4. The invention as defined in claim 1 wherein each upstream pair of sprocket wheels is operationally connected to a corresponding pair of downstream sprocket wheels by a longitudinal shaft.

* * * * *